United States Patent [19]

Sarvanne

[11] Patent Number: 4,676,718

[45] Date of Patent: Jun. 30, 1987

[54] IMPELLER FOR A PUMP, ESPECIALLY A VORTEX PUMP

[75] Inventor: Hannu Sarvanne, Vantaa, Finland

[73] Assignee: Oy E. Sarlin AB, Helsinki, Finland

[21] Appl. No.: 740,367

[22] Filed: Jun. 3, 1985

[51] Int. Cl.[4] ..... F04D 29/24

[52] U.S. Cl. ..... 415/213 A; 416/185

[58] Field of Search ..... 416/177, 179, 182, 183, 416/186, 188, 235, 236 R, 236 A, 237, 185; 415/213 A, 213 B, 213 R, 121 B

[56] References Cited

U.S. PATENT DOCUMENTS

| | | | |
|---|---|---|---|
| Re. 14,988 | 11/1920 | Parsons | 415/214 |
| 224,870 | 2/1880 | Bush | 416/185 |
| 1,149,904 | 8/1915 | Foster | 416/185 |
| 1,649,161 | 11/1927 | Foster | 416/185 |
| 2,202,790 | 5/1940 | Forrest | 415/213 A |
| 2,350,939 | 6/1944 | Sprouse | 416/185 |
| 3,124,200 | 3/1964 | Wilson | 416/182 |
| 3,171,357 | 3/1965 | Egger | 415/206 |
| 3,610,590 | 10/1971 | Kaelin | 416/186 |
| 3,637,196 | 1/1972 | Kaelin | 416/183 |
| 3,669,563 | 6/1972 | Corbett | 416/185 X |
| 3,741,682 | 6/1973 | Robertson | 416/179 |
| 3,746,465 | 7/1973 | Van Doorn et al. | 416/177 |
| 3,759,628 | 9/1973 | Kempf | 415/213 A |
| 3,984,193 | 10/1976 | Yu | 416/185 |
| 4,047,843 | 9/1977 | Zeidler et al. | 416/185 |
| 4,151,231 | 4/1979 | Austin et al. | 416/182 |
| 4,378,093 | 3/1983 | Keener | 415/121 B |

FOREIGN PATENT DOCUMENTS

| | | | |
|---|---|---|---|
| 1528890 | 1/1970 | Fed. Rep. of Germany | 416/185 |
| 2206175 | 2/1973 | Fed. Rep. of Germany | 416/185 |
| 492190 | 3/1954 | Italy | 416/185 |
| 403 | 1/1978 | Japan | 416/185 |
| 137102 | 10/1979 | Japan | 416/185 |

*Primary Examiner*—Everette A. Powell, Jr.

*Attorney, Agent, or Firm*—Browdy and Neimark

[57] ABSTRACT

An impeller for a pump, especially a vortex pump, provided with one or more straight or curved vanes arranged radially. Vortex pumps are used e.g. for pumping sewage, for which purpose they are well adapted. However, a drawback with such pumps known so far has been a rather low efficiency and a low lift curve. In the vortex pump of the invention, this problem is eliminated by providing the edges of the vanes with flanges essentially perpendicular to the vane surface.

7 Claims, 7 Drawing Figures

Fig. 1
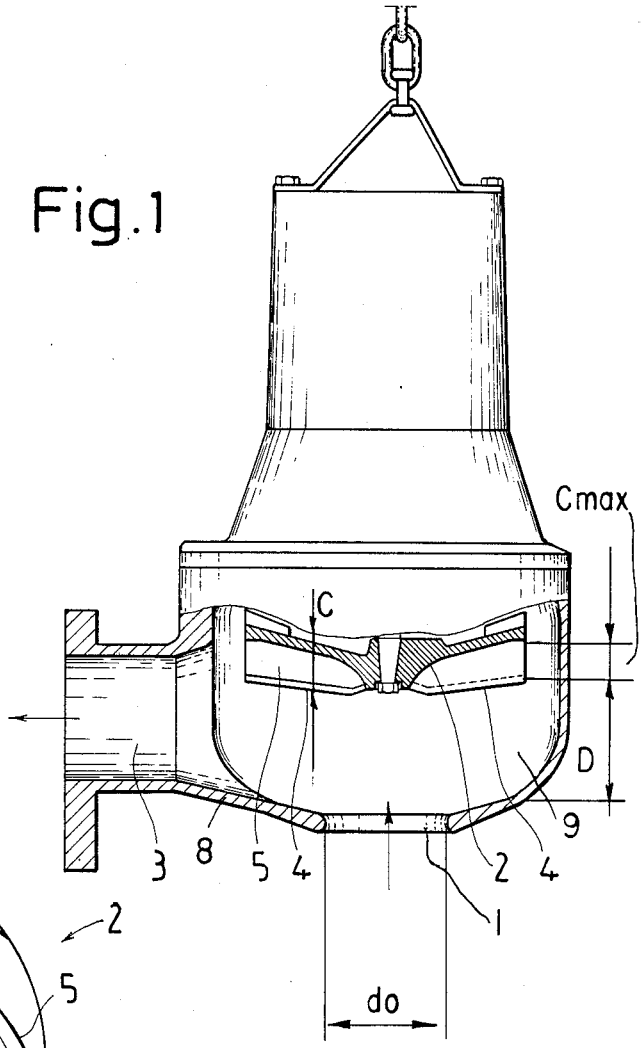
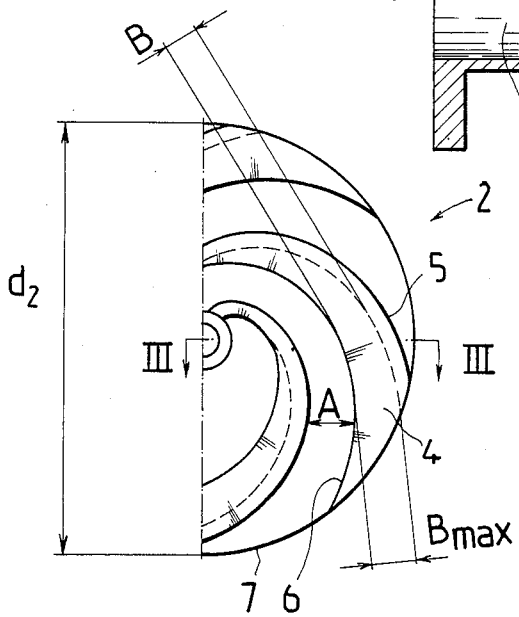
Fig. 2
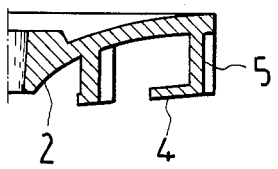
Fig. 3

IMPELLER FOR A PUMP, ESPECIALLY A VORTEX PUMP

BACKGROUND OF THE INVENTION

The present invention concerns an impeller for a pump, especially a vortex pump, the said impeller being provided with one or more straight or curved vanes arranged radially.

For the purpose of pumping sewage, the vortex pump has proved to be the most advantageous type of pump in respect of proneness to blockages, durability, running stability and production costs. Furthermore, the vortex pump is well adapted for pumping silt and pulp as well as for applications involving heavy wear, e.g. for use in places where sand can enter the pump. A typical feature of a vortex pump is that it has between the impeller and the pump housing a wide space without vanes, the width of the space corresponding to the flow capacity of the pump. Moreover, the impeller vanes used in vortex pumps are not provided with front edges transverse to the flow passage, on which solid substances of long fibrelike structure could be entagled. However, a drawback with prior-art vortex pumps is a low efficiency and a low lift curve. This is due to the fact that a detrimental flow takes place over the edges of the impeller vanes, which is again due to the difference of pressure above and below the vanes.

OBJECT OF THE INVENTION

The object of the present invention is to achieve a vortex pump impeller having an essentially improved efficiency and lift curve. Accordingly, the vortex pump impeller of the invention is characterized in that the edges of the vanes are provided with flanges essentially perpendicular to the vane surface. These flanges effectively prevent the detrimental flow over the vane edges, considerably improving the pump efficiency and lift curve.

An advantageous embodiment of the invention is characterized in that the distance between a flange and the adjacent vane increases towards the circumference of the impeller. This ensures that no solid substances are packed in this space.

Among other advantages, the invention offers an improved impeller durability, because the flanges prevent the turbulent flow over the vane edges that causes wear of the vanes when liquids containing abrasive substances are pumped. Also, a more "gentle" flow of liquid through the pump is achieved due to the presence of the flanges. This is of importance e.g. when the pump is used for pumping active sludge in a sewage purification plant, because the flakes in the sludge must not be disrupted during pumping. The greater gentleness of flow is also due to the absence of turbulent flow over the vane edges, for it is the turbulence that causes disruption of sludge flakes.

In the following, the invention is described in greater detail by the aid of examples, reference being made to the drawings attached.

BRIEF DESCRIPTION OF THE DRAWINGS

FIG. 1 presents a sectional view of a vortex pump with impeller vanes according to the invention.

FIG. 2 presents an advantageous embodiment of the vortex pump impeller of the invention, with the flanges placed on the back side of the vanes.

FIG. 3 presents a section through the impeller in FIG. 2 along the line III—III.

DETAILED DESCRIPTION OF A PREFERRED EMBODIMENT

Figure 4:
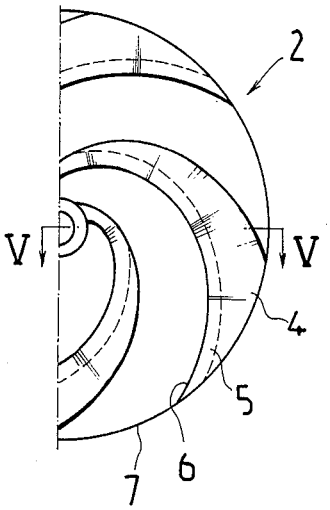
FIG. 4 presents another advantageous embodiment of the vortex pump impeller of the invention, with the flanges placed on the front side of the vanes.

FIG. 1 presents a sectional view of a vortex pump in accordance with the invention. Drawn by the suction caused by the low pressure, the liquid to be pumped enters the pump housing 8 via aperture 1 of diameter $d_o$ and is expelled by the impeller 2 via aperture 3. In accordance with the invention, the edges of the vanes 5 are provided with flanges 4, which prevent liquid flow over the vane edges.

Figure 5:
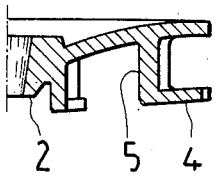
FIG. 5 presents a section through the impeller in FIG. 4 along the line V—V.

As shown in FIGS. 2 and 3, the flanges 4 may be placed on the back side of the vane edges. It is to be recommended that the flanges be arranged perpendicular to the vanes. In FIGS. 4 and 5 the flanges are on the front side of the vanes, in FIGS. 6 and 7 partly on the front side, partly on the back side. The positioning of the flanges relative to the vanes can be decided according to the conditions in each case.

A free flow space 9 of height D is provided between the pump housing 8 and the impeller 2, allowing the passage of solids. As shown in FIG. 1, the height D of the free flow space is roughly about 3 times the maximum height $C_{max}$ of the vanes 5.

It has been found in tests that the use of flanges according to the invention improves the pump efficiency and lifting capacity by as much as 43%.

Figure 6:
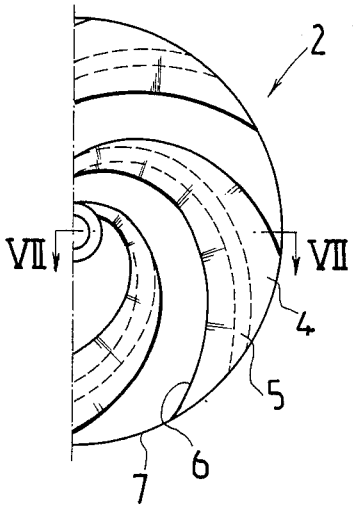
FIG. 6 presents a third advantageous embodiment of the vortex pump impeller of the invention, with the flanges placed partly on the front side, partly on the backside of the vanes.
Figure 7:
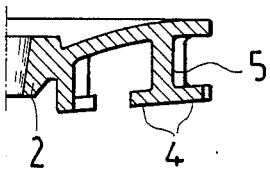
FIG. 7 presents a section through the impeller in FIG. 6 along the line VII—VII.

As shown in FIGS. 2, 4 and 6, the distance A from a flange 4 to the next vane increases towards the circumference of the impeller 1. This serves the purpose of preventing solid substances contained in the sewage or equivalent from getting stuck between the vanes. The width of the flanges also increases along the vane toward the circumference 7. The inner edge 6 of the flange extends in a spiralling form to the circumference of the impeller.

The ratio of the maximum height of the flange 4 to the external diameter of the impeller ($B_{max}/d_2$) has a value between 0.03–0.20, most advantageously between 0.07–0.14.

It is obvious to a person skilled in the art that the invention is not exclusively confined to the examples of embodiments discussed above, but may instead be varied within the scope of the claims presented below.

I claim:

1. A vortex pump comprising a pump housing (8) having an intake aperture (1) of diameter ($d_o$), an impeller (2) with curved vanes (5) rotating inside said pump housing (8) and being located on one side of the pump housing (8) so that between the pump housing (8) and the impeller (2) is defined a free flow space (9) for allowing passage of large pieces of solid, said free flow space (9) having a width (D) approximately equal to said diameter ($d_o$), said width (D) of the free flow space (9) being roughly about 3 times the maximum height ($C_{max}$) of said vanes, and said impeller (2) further having curved flanges (4) provided on margins of the vanes (5) adjacent to the intake aperture (1) to extend substantially perpendicularly from the surfaces of the vanes (5) in the direction of the widening towards the outer circumference (7) of the impeller (2), wherein the distance (A) between adjacent flanges (4) and vanes (5) increases in the direction towards the outer circumference (7) of the impeller (2), the width (B) of each flange (4) increases uniformly from zero up to a maximum value ($B_{max}$) at said outer circumference (7), an edge (6) of each flange continues in helical fashion up to the outer circumference (7), the ratio ($B_{max}/d_2$) of the maximum height ($B_{max}$) of the flange (4) from the vane 5 to the diameter ($d_2$) of the impeller (2) is in the range of 0.07 to 0.14, and the height (C) of the vanes (5) increases towards said outer circumference (7).

2. The pump of claim 1, wherein said flanges (4) are disposed on the front side of the vanes (5) with respect to the rotation of said impeller (2).

3. The pump of claim 1, wherein said flanges (4) are disposed on the back side of the vanes (5) with respect to rotation of the impeller (2).

4. The pump of claim 1, wherein said flanges (4) are placed partly on the front side, and partly on the back side, of the vanes (5) with respect to rotation of the impeller (2).

5. The pump of claim 1, wherein an edge of each flange (4) extends in a spiralling form to the outer circumference (7) of the impeller (2).

6. The pump of claim 1, wherein the height of said flanges (4) from each respective vane (5) is zero at the innermost radial position along the vane.

7. The pump of claim 1, wherein said flanges (4) define a substantially flat but slight cylindrical surface from an innermost position in the radial direction to said outer circumference (7) of said impeller (2).

* * * * *